US007871230B2

(12) United States Patent
Kubo et al.

(10) Patent No.: US 7,871,230 B2
(45) Date of Patent: Jan. 18, 2011

(54) MOLD DEVICE, EASY-OPEN END, METHOD OF MANUFACTURING EASY-OPEN END, AND LAMINATED STEEL SHEET FOR EASY-OPEN END

(75) Inventors: Hiroshi Kubo, Tokyo (JP); Katsumi Kojima, Tokyo (JP); Yasuhide Oshima, Tokyo (JP); Yoshihiko Yasue, Tokyo (JP); Hiroki Iwasa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 398 days.

(21) Appl. No.: 11/662,637

(22) PCT Filed: Nov. 22, 2004

(86) PCT No.: PCT/JP2004/017662

§ 371 (c)(1),
(2), (4) Date: Mar. 13, 2007

(87) PCT Pub. No.: WO2006/035514

PCT Pub. Date: Apr. 6, 2006

(65) Prior Publication Data

US 2007/0267423 A1 Nov. 22, 2007

(30) Foreign Application Priority Data

Sep. 27, 2004 (JP) ..... 2004-279241

(51) Int. Cl.
*B21D 51/44* (2006.01)

(52) U.S. Cl. ..... 413/17; 413/12; 413/67; 72/379.4

(58) Field of Classification Search ..... 413/15–17, 413/56, 67, 8, 68; 72/379.4, 325–341, 462, 72/476

See application file for complete search history.

(56) References Cited

U.S. PATENT DOCUMENTS 3,359,773 A * 12/1967 Stuchbery ..... 72/325
3,701,330 A * 10/1972 Kinkel ..... 413/14

(Continued)

FOREIGN PATENT DOCUMENTS

EP 1 046 589 4/2000

(Continued)

OTHER PUBLICATIONS

Granville, "Elements of the Differential and Integral Calculus", 1911, Ginn and Company, Revised Edition, pp. 155-161.*

European Patent Office issued an European Search Report dated Jan. 26, 2009, Application No. 04799864.6.

*Primary Examiner*—Dana Ross
*Assistant Examiner*—Mohammad Yusuf
(74) *Attorney, Agent, or Firm*—Young & Thompson

(57) ABSTRACT

The mold apparatus has a pair of upper and lower molds being used for forming a score on one side surface of an easy-opening can end fabricated by a laminated metal sheet. The upper mold has a convex part for forming the score, and the cross sectional shape of the convex part at the portion contacting the laminated metal sheet is composed of a curve having a change rate of inclination of 0.08 or smaller to the upper surface of the facing lower mold, or having the curve and a straight line. The formed score has a maximum width of 0.80 mm or smaller.

20 Claims, 2 Drawing Sheets

U.S. PATENT DOCUMENTS

| | | | | | |
|---|---|---|---|---|---|
| 3,728,980 | A | * | 4/1973 | Fraze | 72/325 |
| 3,898,944 | A | * | 8/1975 | Holk et al. | 72/341 |
| 4,031,836 | A | | 6/1977 | Grise et al. | |
| 4,254,890 | A | * | 3/1981 | Westphal | 413/55 |
| 5,373,721 | A | * | 12/1994 | Welsh et al. | 413/12 |
| 5,738,237 | A | * | 4/1998 | McEldowney | 220/269 |
| 2002/0170913 | A1 | * | 11/2002 | Yamasaki et al. | 220/269 |

FOREIGN PATENT DOCUMENTS

| | | |
|---|---|---|
| GB | 1 275 344 | 5/1972 |
| JP | 06-115546 | 4/1994 |
| JP | 09-234534 | 9/1997 |
| JP | 11-091775 | 4/1999 |
| JP | 11-239837 | 9/1999 |
| JP | 2000-62775 | 2/2000 |
| JP | 2000-177733 | 6/2000 |
| JP | 2000-301268 | 10/2000 |
| JP | 2000-318734 | 11/2000 |
| JP | 2004-298887 | 10/2004 |
| JP | 2004-344933 | 12/2004 |
| JP | 2004-345231 | 12/2004 |
| WO | 00/09406 | 2/2000 |

* cited by examiner

MOLD DEVICE, EASY-OPEN END, METHOD OF MANUFACTURING EASY-OPEN END, AND LAMINATED STEEL SHEET FOR EASY-OPEN END

TECHNICAL FIELD

The present invention relates to a mold apparatus, an easy-opening can end, a method for manufacturing easy-opening can end, and a laminated steel sheet for easy-opening can end, suitable for forming a score on an easy-opening can end fabricated by a laminated steel sheet, and specifically relates to a mold, an easy-opening can end, a method for manufacturing easy-opening can end, and a laminated steel sheet for easy-opening can end, suitable for eliminating repair step on the score portion of the easy-opening can end.

BACKGROUND ART

Materials of easy-opening can end mainly adopt aluminum. Coated steel sheets have a small economical advantage because they need a repair-coating step after forming the can end, though they are inexpensive as the base materials of the can end. Consequently, steel sheets are not positively used in the field. With the background, various trials were given to eliminate the repair-coating step of easy-opening can end fabricated by steel sheet applying a new end-panel working method and using a laminated steel sheet for the method.

As of these trials, JP-A-6-115546, (the term "JP-A" referred to herein signifies the "Unexamined Japanese Patent Publication"), tries to eliminate the repair step by improving the working method for forming the conventional V-shape score that has a flat part at bottom of the score, using a polyester resin. JP-A-9-234534 improves the score-working method while specifying the thickness and the breaking elongation of resin layer. JP-A-11-91775 tries the elimination of repair step using a curved surface mold for score-working.

In spite of these prior technologies, the market is occupied by the aluminum-made end panels. With the above increasing trend for easy-opening can, the easy-opening can end made of aluminum has increased not only in the beverage can market but also in the food can market. The phenomenon shows that the market does not evaluate the merit of switching from the aluminum can end to the laminated steel sheet can end.

The market is reluctant to accept the laminated steel sheet can end is presumably that many of them are inapplicable depending on the required level of can design, can end-panel forming method, can-manufacturing method, and the like, though some of them satisfy these requirements. That is, there exist end panel types and end-panel working conditions that hinder the elimination of repair step for steel end panels. Specific cases of raising the difficulties include an end-panel design requiring further severe score-working to decrease the can-opening force and a temperature-increase in the mold for successively fabricating the end panels affecting the resin working.

Consequently, to eliminate the repair step for almost all kinds of can ends, there are required to establish a working method and a resin that do not induce break of the resin layer even under those severe working conditions.

The conventional score-working method, however, cannot fully eliminate the repair step under those severer score-working conditions. For example, according to a survey given by the inventors of the present invention, the score-working technology disclosed in JP-A-11-91775 is the most promising one in the related art. The disclosure describes score-working using a mold having a curved surface with a constant curvature. That is, the disclosure obtained the residual thickness of the score in a range from 0.025 to 0.080 mm at a radius of curvature of the mold in a range from 0.1 to 1.0 mm. According the disclosure, the workability drastically improved compared with the sharp-notch type in the related art. However, the disclosed technology failed to fully satisfy the above-described severe score-working conditions.

The full scale introduction of the laminated steel sheets to the market is achieved if the above problems are solved. The full scale introduction of the inexpensive laminated steel sheets to the market not merely decreases the can cost. That is, since the all-steel cans are superior in the recycle point of view and since the steel base material is the one applying lighter load to environment compared with aluminum, the shift of base material has significance also in the industries.

DISCLOSURE OF THE INVENTION

An object of the present invention is to provide a mold, an easy-opening can end, and a method for manufacturing easy-opening can end, suitable for realizing the elimination of repair step for the easy-opening can end fabricated by a laminated steel sheet even under further severe score-working conditions. Another object of the present invention is to provide a laminated steel sheet for easy-opening can end, suitable for the elimination of repair step for the score portion.

To achieve the above objects, the present invention provides a mold apparatus having an upper mold and a lower mold facing the upper mold, thereby forming a score on one side of a can end fabricated by a laminated metal sheet. The upper mold has a convex part for forming the score. The convex part has a specified cross sectional shape at a part contacting the laminated metal sheet. The cross sectional shape is composed of a curve having a change rate of inclination of 0.08 or smaller to the upper surface of the facing lower mold, or having the curve and a straight line. The formed score has a maximum width of 0.80 mm or smaller.

The upper surface of the lower mold facing the convex part for forming the score of the mold is preferably flat and in parallel with the end-panel surface.

The cross sectional shape of the convex part for forming the score is preferably composed of a curve having a change rate of inclination of 0.050 or smaller to the upper surface of the facing lower mold, or having the curve and a straight line.

The cross sectional shape is preferably further composed of a curve having a change rate of inclination of 0.01 or smaller to the upper surface of the facing lower mold, or having the curve and a straight line, and the formed score has a maximum width of 0.75 mm or smaller.

Although the cross sectional shape of the convex part may be in an arbitrary shape that satisfies the specified conditions, specifically the cross sectional shape may be the following:

(a) The cross sectional shape of the convex part has a single curvature;

(b) The cross sectional shape of the convex part is in an inverted triangular shape, and the tip portion of the convex part has a single curvature;

(c) The cross sectional shape of the convex part is composed of an elliptical curve;

(d) The cross sectional shape of the convex part is in an inverted triangular shape, and the tip portion of the convex part is composed of an elliptical curve;

(e) The cross sectional shape of the convex part is composed of a single curvature at the inclined surface, and has a flat part at center of the convex part;

(f) The cross sectional shape of the convex part is in an inverted triangular shape, and is composed of s single curvature at lower part of the inclined surface, and has a flat part at center of the convex part;

(g) The cross sectional shape of the convex part is composed of an elliptical shape at the inclined surface, and has a flat part at center of the convex part;

(h) The cross sectional shape of the convex part is in an inverted triangular shape, is in an elliptical shape at lower part of the inclined surface, and has a flat part at center of the convex part; and (i) The cross sectional shape of the convex part is in an inverted triangular shape, and is flat at the tip portion thereof.

When the cross sectional shape of the convex part of (a) has a single curvature, the radius of curvature is preferably in a range from 0.28 to 0.53 mm, more preferably from 0.31 to 0.53 mm, and most preferably from 0.46 to 0.48 mm.

The easy-opening can end is manufactured by press-forming a laminated metal sheet using the above mold apparatus.

The method for manufacturing easy-opening can end has the step of forming a score by press-forming a laminated metal sheet using the above mold apparatus.

The polyester resin laminated steel sheet being used for the easy-opening can end or for manufacturing the easy-opening can end is the following.

(A) The laminated steel sheet for easy-opening can end, in which the polyester resin layer is prepared by laminating, by thermal melt-bonding method, any of the stretched films (1) to (5); the film is prepared by polycondensation of a dicarboxylic acid component and a diol component; the dicarboxylic acid component is composed of terephthalic acid or terephthalic acid and isophthalic acid; the diol component is composed of ethylene glycol and/or butylene glycol; and a repeating unit composed of ethylene terephthalate or butylene terephthalate, in the stretched film, is 85% by mole or more; while the plane orientation factor of the laminated resin layer is 0.06 or smaller:

(1) polyethylene terephthalate—polyethylene isophthalate copolymer, (2) Polyethylene terephthalate, (3) polybutylene terephthalate—polyethylene terephthalate copolymer, (4) Polyethylene terephthalate—polyethylene isophthalate—polybutylene terephthalate copolymer, and (5) Polybutylene terephthalate.

(B) The laminated steel sheet for easy-opening can end, in which the polyester resin layer is prepared by laminating, by thermal compression-bonding method, any of the stretched films (1) to (5); the film is prepared by polycondensation of a dicarboxylic acid component and a diol component; the dicarboxylic acid component is composed of terephthalic acid or terephthalic acid and isophthalic acid; the diol component is composed of ethylene glycol and/or butylene glycol; and a repeating unit composed of ethylene terephthalate or butylene terephthalate, in the stretched film, is 85% by mole or more:

(1) polyethylene terephthalate—polyethylene isophthalate copolymer, (2) Polyethylene terephthalate, (3) polybutylene terephthalate—polyethylene terephthalate copolymer, (4) Polyethylene terephthalate—polyethylene isophthalate—polybutylene terephthalate copolymer, and (5) Polybutylene terephthalate.

(C) The laminated steel sheet for easy-opening can end, in which the polyester resin layer is prepared by laminating, by extrusion method, any of the stretched films (1) to (5); the film is prepared by polycondensation of a dicarboxylic acid component and a diol component; the dicarboxylic acid component is composed of terephthalic acid or terephthalic acid and isophthalic acid; the diol component is composed of ethylene glycol and/or butylene glycol; and a repeating unit composed of ethylene terephthalate or butylene terephthalate, in the stretched film, is 85% by mole or more:

(1) polyethylene terephthalate—polyethylene isophthalate copolymer, (2) Polyethylene terephthalate, (3) polybutylene terephthalate—polyethylene terephthalate copolymer, (4) Polyethylene terephthalate—polyethylene isophthalate—polybutylene terephthalate copolymer, and (5) Polybutylene terephthalate.

Score-working on an easy-opening can end fabricated by a laminated steel sheet using the mold of the present invention prevents breaking of the resin layer and actualizes the elimination of the repair step of the score portion even under severe score-working conditions, thereby allowing manufacturing inexpensive easy-opening can end.

The laminated steel sheet according to the present invention has an excellent balance of elongation and strength. By applying score-working using the laminated steel sheet of the present invention as the base material for the easy-opening can end and using the mold of the present invention, the-preventive effect to the break of resin layer at the score portion is effectively attained.

BRIEF DESCRIPTION OF THE INVENTION

Figure 3:
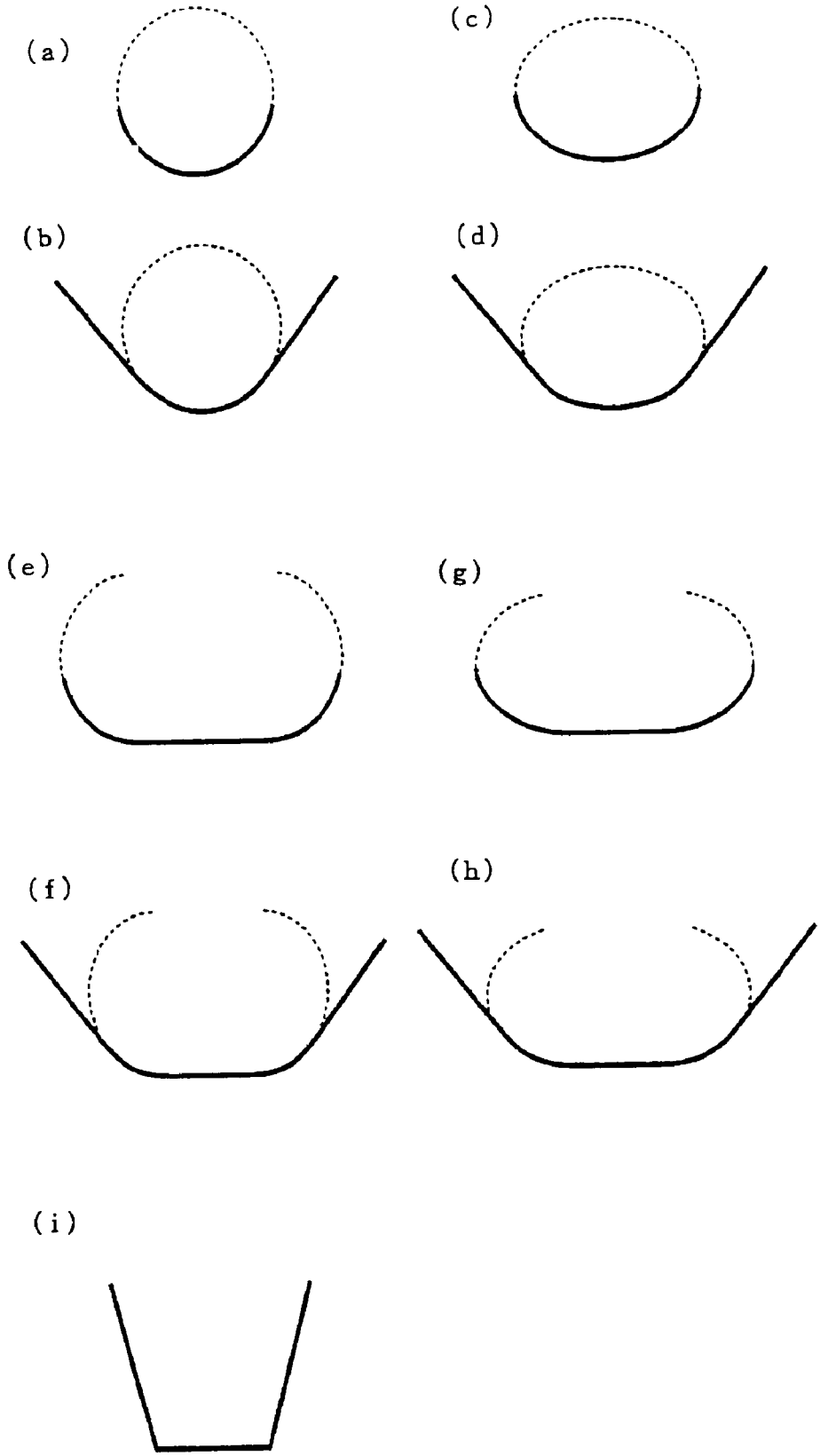

FIGS. 3(*a*) to (*i*) illustrate the shape of the convex part for forming a score on the upper mold used in Example 1.

EMBODIMENTS OF THE INVENTION

The present invention deals with a mold which forms a score only on one side of the easy-opening can end, specifically which forms a score (score groove) on the end-panel surface becoming the outer surface of the can. According to the present invention, therefore, the convex part for forming the score exists only on the upper mold.

The score is formed only on one side of the end-panel surface using the upper mold because, if the score is formed also at the side contacting the lower mold, or if the score is formed on both sides of the end-panel, the drawbacks described below occur.

(A) Wear of the mold becomes significant.

(B) Control of the score residual thickness becomes difficult.

It is necessary that the corrosion resistance at the inner surface side of the can, contacting the contents, is good compared with that at the outer surface side thereof. Also in this respect, it is more advantageous that the score is not formed on the inner surface side of the can, and that the score is formed only on the outer surface side of the can.

Figure 1:
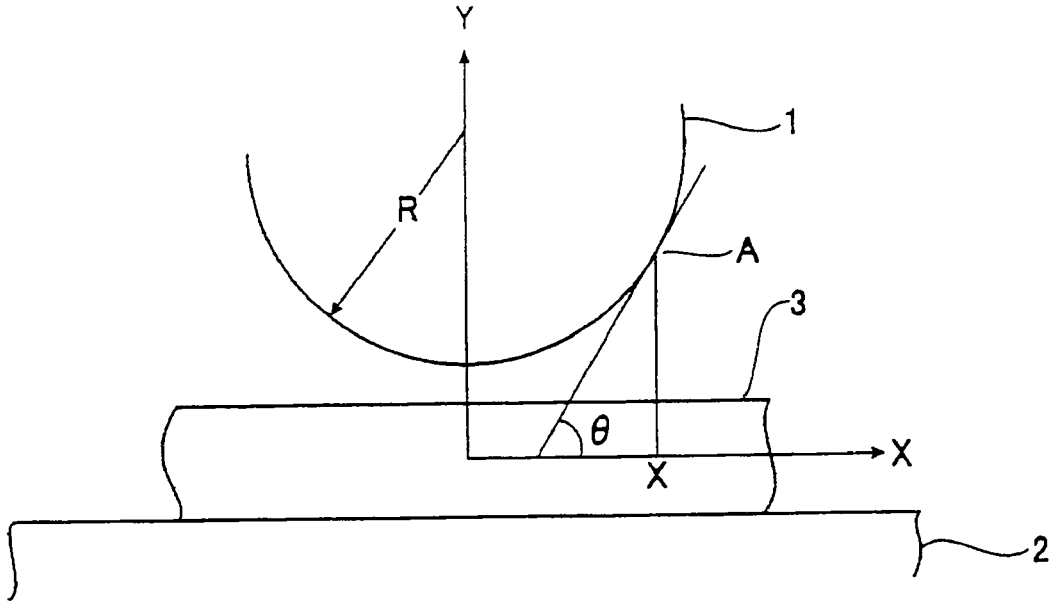
FIG. 1 illustrates the change rate of inclination of the score mold to the steel sheet surface.

For the mold for forming the score, which is disclosed in JP-A-11-91775 which is one of the related art, the inventors of the present invention gave a detail investigation. As shown in FIG. 1, the mold for forming the score is structured by a pair of molds, an upper mold and a lower mold. The upper mold has a convex part for forming the score having a single curvature, while the lower mold is in a flat and smooth shape. The workability of the polyester-based resin laminated steel sheet was investigated using the above pair of molds. The term "mold having a convex part for forming the score" referred to herein is written as the "score mold". Since, in the above example, the upper mold has a convex part for forming the score, the embodiments of the present invention describe the "upper mold" also as the "score mold".

The investigation began from the study of deterioration of workability accompanied with the temperature increase. With increase in the working temperature, the resin layer likely breaks. A detail investigation about the breaking position in the score, however, showed a tendency that the breaking position is not near the score center where the working degree of the resin layer becomes the maximum level, (at a portion where the score depth becomes maximum level), but at score edge part where the degree of working is relatively small. Generally, the polyester-based resins increase the elongation and decrease the strength with increase in the temperature. Therefore, the cause of the break is speculated as the decrease in the strength of resin resulted from the increase in the temperature.

Then, the relation between the degree of score working and the resin break was investigated. It was found that, in a range of small radius of curvature of the score, increase in the degree of score working likely induces the break of score at edge part thereof, and, in a zone of large radius of curvature, the score center part where the resin layer becomes thinnest likely breaks. If the score working condition is determined so as to give the same score residual thickness, larger radius of curvature gives larger degree of working. Therefore, the break of resin layer at the thinnest part supposedly occurs at the limit of elongation of the resin layer.

It is concluded that, in the score working using a score mold in a curved shape, the breaking mode of resin layer has two types: the breaking at the score center part (at the thinnest part of the resin layer); and the breaking at the score edge part. The break near the score center part was accepted as the break resulting from the elongation limit. Although the mechanism of breaking at score edge part is not fully analyzed, it is speculated that the variables relating to the strength of resin contribute to the break because it was observed that the workability at edge part deteriorates with increase in the temperature. Considering the fact that the break resulting from the decrease in the strength of resin occurs at score edge part, and that the break likely occurs at a portion of small radius of curvature of the mold, it is speculated that the variables common to the score edge part and the score having small radius of curvature contribute to the breaking phenomenon. The variables common to the score edge part and the score having small radius of curvature presumably include: (i) large inclination of the part of score mold, contacting the steel sheet, to the steel sheet surface, and (ii) large change rates of inclination of the score mold, contacting the steel sheet, to the steel sheet surface.

When the upper mold (score mold) has a convex part for forming the score having a single curvature, and if the score is formed by a pair of molds having the lower mold with flat and smooth surface at upper surface thereof, the inclination of the upper mold, at the point A in the inclined part, to the steel sheet surface is defined as tan θ, and the change rate of inclination of the upper mold, at the point A, to the steel sheet surface is defined as dtan θ/dx.

The point A is the point in the inclined part corresponding to the horizontal position x, defining the origin in FIG. 1 as the lowest part of the convex part of the upper mold.

The angle θ is an included angle between the tangent line at the point A on the inclined part of the convex part 1 of the upper mold and the surface of the steel sheet 3 before working.

According to the example of the mold, where the upper surface of the lower mold 2 is flat and in parallel with the end surface (surface of the laminated metal sheet), the inclination of the upper mold, at the point A, to the steel sheet surface is the same to the inclination to the upper surface of the lower mold facing the point A, and the change rate of inclination of the upper mold, at the point A, to the steel sheet surface is the same to the change rate of inclination to the upper surface of the lower mold facing the point A of the upper mold.

The following description is, in the present invention, about the reasons of specifying the cross sectional shape of a portion of the convex part of the upper mold contacting the metal sheet by the change rate of inclination to the upper surface of the lower mold facing a portion of the convex part of the upper mold contacting the metal sheet.

As described above, in the score working, the change rate of inclination of the upper mold to the laminated metal sheet immediately before the working is important. Since the laminated metal sheet immediately before the working has almost equal inclination to that of the upper surface of the lower mold, the change rate of inclination to the upper surface of the lower mold is adopted as the specification.

The change rate of inclination can be determined, for example, by the method to determine the cross sectional shape of the mold using a laser roughness tester, (determining the changes of height (y) at a constant pitch (x)). In that case, the value of [ dtan θ/dx] is derived from the aggregate of measurement points, as the inclination (1)=(y2−y1)/Δx, the inclination (2)=(y3−y2)/Δx, the change rate of inclination=(Inclination (2)−Inclination (1))/Δx, (Δx is an interval of measurement). Smaller interval of measurement can grasp further detail shape of the mold. To the present invention, the interval of measurement is required to set to at least 10 μm or smaller, and preferably about 1 μm. The change rate of inclination is the value per 1 μm of interval of measurement.

Various upper molds having different sizes of convex part were prepared. As the lower mold, a mold having upper surface in a flat and smooth shape was prepared, (refer to the symbol 12 in FIG. 2). With thus prepared upper mold and lower mold, an investigation was given to determine the controlling variable, either (i) or (ii), given before. The inclination of the upper mold to the steel sheet surface is the same to the inclination to the facing upper surface of the lower mold, and the change rate of inclination of the upper mold to the steel sheet surface is the same to the change rate of inclination to the upper surface of the lower mold facing the upper mold. The following description refers to as the change rage of inclination of the upper mold to the steel sheet surface, which is the same to the change rate of inclination of the upper surface of the lower mold facing the upper mold.

Figure 2:
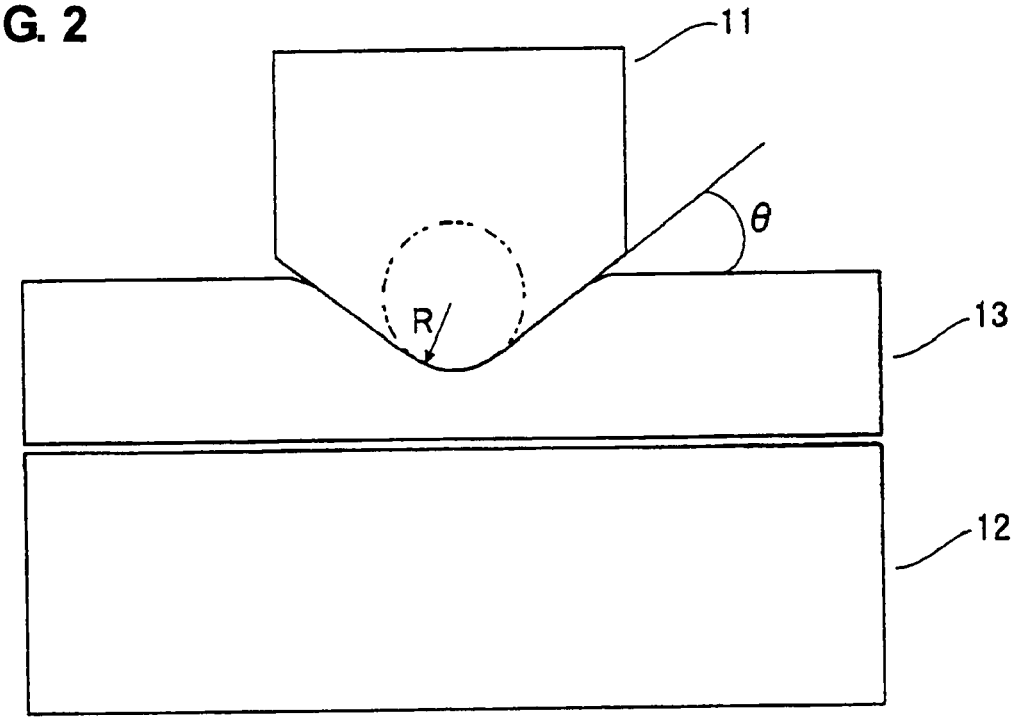
FIG. 2 illustrates the score mold having a convex part, which convex part has a cross section in an inverted triangular shape, and the tip portion of the inverted triangular shape has a curved shape with a certain curvature.

The prepared score mold (upper mold) is a score mold in which the cross sectional shape of the convex part for forming the score is in an inverted rectangular shape, and the inclination of the two oblique sides of the inverted rectangle to the steel sheet is tan [tan θ=0.7], (θ is the included angle between the steel sheet surface and the oblique sides), and the tip portion of the inverted triangle is in a curved shape with a constant curvature, (refer to the symbol 11 in FIG. 2). The curved part and each of the oblique sides smoothly contact with each other not to induce abrupt change in the inclination, or the oblique sides circumscribe the circle that forms the curve. The score molds having different curvatures at the tip portion of the convex part of the mold from each other were prepared for experiment. The feature of the score molds is that the change rate of inclination at the tip portion differs from each other, though the maximum inclination to the steel sheet surface is the same with each other. If the score workability is the same independent of the curvature at the tip portion, the inclination of the mold to the steel sheet will become the controlling variable. If the score workability becomes worse with decreased radius of curvature at the tip portion, the change rate of inclination will become the controlling variable.

The investigation revealed that, even with the same maximum inclination of the score mold to the steel sheet surface, smaller radius of curvature at the tip portion deteriorates the workability. In addition, the observation of broken part showed that the break occurred at the curved part. That is, the break of resin occurred not at a part giving large inclination, but at a part giving large change rate of inclination of the score mold to the steel sheet surface.

The above investigations and consideration to the score working are summarized to two points as follows.

(i) Increased working degree likely induces break of resin at the elongation limit; and (ii) Increased change rate of inclination of the score mold to the steel sheet surface likely induces break of resin at the strength limit.

The inventors of the present invention expected the possibility of attaining drastically improved score workability by the design of score mold on the basis of the finding, and conducted the design of new score mold.

It is expected that the degree of working is correlated with the volume of steel sheet expelled by the mold, (the volume of steel sheet that is pushed aside by the score mold), and that simply smaller size of score is preferred.

Regarding the change rate of inclination of the score mold to the steel sheet surface, the situation is somewhat complicated. First, a problem is the adequate range of the change rate of inclination of the score mold to the steel sheet surface. To this point, the inventors of the present invention prepared score molds having different shapes and different change rates of inclination to the steel sheet surface under the condition of a fixed score width and a working temperature of 80° C., and carried out investigations to compare the workability among them. The various shapes include the shape of convex part of the score mold in: a single curvature shape, the above-described inverted triangular shape, an elliptical shape, a shape having a flat part at center of the single curvature shape, a shape having a flat part at center of the inverted triangular shape, a shape having a flat part at center of the elliptical shape, and the like. The investigations revealed that the change rate of inclination of the score mold to the steel sheet surface regulates the workability independent of the shape of the score mold. If the change rate of inclination of the score mold to the steel sheet surface exceeds 0.08, the resin break likely occurs independent of the degree of working (degree of elongation) at the part. That is, the break at the strength limit of the resin was found to be effectively suppressed by bringing the change rate of inclination of the score mold to the steel sheet surface to 0.08 or smaller.

When a mold is designed so as the change rate of inclination of the score mold to the steel sheet surface to become 0.08 or smaller, the target degree of working has to be settled. For example, with a mold having a curved surface with a single curvature, the maximum change rate of inclination of the score mold to the steel sheet surface varies not only with the curvature but also with the degree of working. That is, when the degree of working is small, (when the denting depth at the convex part for forming the score is shallow), the portion affecting the working is solely the tip portion of the convex part for forming the score. If, however, the degree of working is large, (if the denting depth at the convex part for forming the score is deep), further wide range affects the degree of working. For the case of the score mold having a single curvature, the inclination of the score mold to the steel sheet surface increases with increase in the distance apart from the center of the score toward the edge thereof, and, the inclination thereof abruptly increases at a certain distance. For example, when a steel sheet having a thickness of 0.200 mm is worked using a score having a single radius of curvature of 0.2 mm, if the target residual thickness of the score is 100 μm, the maximum change rate of inclination of the score mold to the steel sheet surface is 0.039 (dtan θ/dx) at the maximum. If, however, the target residual thickness of the score is 75 μm, the maximum change rate thereof becomes 0.093, and if the target thickness thereof is 50 μm, the maximum change rate of inclination becomes 0.311. Thus, it was confirmed that the change rate of inclination of the score mold to the steel sheet surface significantly varies with the target residual thickness of score even when the score is formed by a single curvature.

The issue to be solved by the present invention is to achieve the elimination of repair step on the cans and under the working conditions which were difficult to remove the step in the related art. Accordingly, the target degree of working and working conditions are required to be applicable to the severest level among the end panels currently manufactured. From this point of view, the inventors of the present invention conducted the evaluation on the indexes of 0.230 mm of thickness, 60 μm of score residual thickness, 25° C. and 80° C. of working temperature, respectively, and 30 μm of thickness of resin layer: The selection of two levels of working temperature is because, although increase in the working temperature decreases the resin strength, the elongation shows an increasing tendency, thus the working at low temperatures is severe for the break at the elongation limit, and working at elevated temperatures is severe for the break at the strength limit. On practical applications, good workability has to be attained for both temperature levels. Although thicker resin layer is more advantageous, increased thickness increases the cost. The thickness of resin layer is selected to 30 μm because of the necessity of selecting the range to attain effective cost merit of elimination of repair step.

For those severe indexes, it is possible to prevent breaking at the strength limit if only the change rate of inclination of the score mold to the steel sheet surface is 0.08 or smaller, as described before. On the other hand, it was found that the score width of 0.80 mm or smaller is sufficient to prevent breaking at the elongation limit. Although there were many of materials not-breaking at the elongation limit even when the score width exceeded 0.80 mm in some mold shapes, the score width was specified to 0.80 mm or smaller considering arbitrary score shapes having 0.08 or smaller change rate of inclination of the mold to the steel sheet surface. If only the score width is 0.80 mm or smaller, there is no problems of end-panel design.

With the specification of 0.80 mm of the score width and of 0.08 or smaller change rate of inclination of the score mold to the steel sheet surface, the score shape according to the present invention can be in arbitrary shape. Examples of the shapes are: a single curvature shape (refer to FIG. 3(*a*)); an inverted triangular shape (refer to FIG. 3(*b*)); an elliptical shape (refer to FIG. 3(*c*)); a shape of inserting a flat part at center of a single curvature shape (refer to FIG. 3(*e*)); a shape of inserting a flat part at center of an inverted triangular shape (refer to FIG. 3(*f*)); and a shape of inserting a flat part at center of an elliptical shape (refer to FIG. 3(*g*)). For more detail example of the shapes, the single curvature shapes of 0.28 to 0.53 mm of radius of curvature is in the range of the present invention. Furthermore, with a structure of inserting a flat part of 0.020 mm in length at center of a single curvature, the radius of curvatures from 0.28 to 0.50 mm is the range of the present invention. With a type of inverted triangular shape, which is described above, examples include a shape of 0.10 mm of radius of curvature at the tip portion and 1.5 of inclination of the oblique side, and a shape of 0.32 mm of radius of curvature at the tip portion and 0.67 of inclination of the oblique side. Another example is a shape that inserts a flat part with 0.020 mm in length at center of the above examples. With the elliptical shape, examples are a shape with 0.30 mm of major axis and 0.25 mm of minor axis, a shape with 0.40 mm of major axis and 0.30 mm of minor axis, the major axis being in parallel with the steel sheet surface, and a shape inserting a flat part with 0.20 mm in width at center of the elliptical shape.

The present invention is also applicable to forming the score under further severe conditions (such as decrease in the thickness of resin layer) simply aiming at further cost reduction. That is, the aim is achieved by selecting the maximum change rate of inclination of the score mold to the steel sheet surface to 0.050 or smaller. For an example of the convex part of the score mold formed by a single curvature, the radius of curvature is in a range from 0.31 to 0.53 mm. Other examples are a shape of inverted triangle at the convex part of the score mold having 0.25 mm of curvature at the tip portion and 2.0 of inclination of the oblique side, and a shape of elliptical convex part having 0.4 mm of major axis and 0.27 mm of minor axis. Further severe conditions (such as decreasing the score residual thickness for further improving the can openability) are satisfied by selecting the maximum change rate of inclination to 0.01 or smaller and the maximum score width to 0.75 mm. For an example of a shape of single curvature of the convex part of the score mold, the radius of curvature becomes very narrow, in a range from 0.46 to 0.48 mm. For other examples, a shape of inverted triangle at the convex part of the score mold having 0.30 mm of curvature at the tip portion and 0.7 of inclination of oblique side, and a shape of elliptical convex part with an oblique side similar to above (for example, a shape having 0.30 mm of major axis, 0.25 mm of minor axis, and 0.92 of inclination of the oblique side, with the major axis being in parallel with the steel sheet surface).

The above description is given on an assumption that the upper surface of the lower mold is flat. From the point to prevent the break of resin during score working, however, it was found that the change rate of inclination of the upper mold to the laminated metal sheet is important even for a mold with not-flat upper surface of the lower mold. Accordingly, if the change rate of inclination of the upper mold to the steel sheet surface is brought into the range of the present invention, the upper surface of the lower mold is not necessarily limited to a flat shape. For example, the portion of the upper surface of the lower mold facing the convex part of the upper mold may be in a concave shape. In this case, the laminated metal sheet under working is presumably deformed in a concave shape along the upper surface of the lower mold. As a result, when the upper surface of the lower mold is formed in a concave shape, the change rate of inclination of the upper mold to the steel sheet surface can be decreased compared with the case of flat upper surface of the lower mold, thus the effect to prevent the breaking of resin during the score working further increases.

If the upper surface of the lower mold is in a concave shape, the change rate of inclination of the convex part of the upper mold, at a portion contacting the laminated metal sheet, to the lower mold can be determined by a similar procedure with that of the case of flat upper surface of the lower mold. That is, the cross sectional shape of the upper mold and of the lower mold is determined by a laser roughness tester, and the changes of height (y) of the upper mold are calculated on the basis of the upper surface of the lower mold at a constant pitch (x), thus applying the similar procedure as above.

The concave shape referred to herein includes a single curvature having 3.0 mm of radius of curvature in the vicinity of the score. The lower mold may be in a convex shape if the shape is not a sharp shape as the score. The convex shape is, however, a not favorable shape to the change rate of inclination so that the combination with the upper mold is necessarily considered to enter the range of the present invention. An example is a shape having 5.0 mm of radius of curvature of the lower mold.

The above description is given on the break of resin layer at the outer surface side (the end panel becoming the outer surface of the container). For the score working, the working of outer surface side of the end panel to which the upper mold contacts is relatively severe compared with the working of the inner surface side. Since, however, also the inner surface side is subjected to the working responding to the score working, increased working degree may result in breaking. Therefore, the evaluation was given on the outer surface side, subjecting severer working, as the index, and then the workability of the inner surface side was confirmed. The investigation revealed that, within the range of the present invention, when the resin layer on the outer surface side is not broken, the resin layer on the inner surface side (the end panel becoming the inner surface side of the container) is not broken, and that the corrosion resistance becomes better.

The present invention specifies the kinds of the resin for the laminated steel sheet because those kinds of the resins show excellent balance of elongation and strength during the score formation using the score mold according to the present invention. Even when the resin kinds are the same to those in the present invention, if the quantity of oriented crystals in the resin increases by stretching and the like, the balance becomes inadequate. Consequently, the present invention specifies the plane orientation factor to 0.06 or smaller. If the plane orientation factor exceeds 0.06, breaking at the elongation limit may occur even within the score-working range of the present invention.

There are various methods to decrease the plane orientation factor to 0.06 or smaller. For film-laminating under arbitrary stretch condition, the laminating temperature may be increased, the laminating rate may be decreased, the temperature of laminate rolls for compression-bonding the film may be increased, the time from lamination to quenching may be increased, and those methods may be combined together. Alternatively, the stretch conditions may be controlled to prepare a film having 0.06 or smaller plane orientation factor, in advance.

The quantity of repeating unit composed of ethylene terephthalate or butylene terephthalate is specified to exist in the resin by 85% by mole or larger because of preventing the increase in the ratio of the residual ethylene isophthalate, which increased content of residual ethylene isophthalate makes the film-formation difficult, and increases the film cost and the film-forming cost.

Addition of a pigment, a lubricant, and other commonly used additives to the resin layer specified in the present invention is effective unless they do not hinder the effect of the present invention. For surface lubrication, it is also effective to apply a wax onto the surface layer or to add a wax component to the resin.

The present invention basically deals with the laminated steel sheet as the laminated metal sheet for easy-opening can end. Laminated metal sheets other than the laminated steel sheet, for example a laminated aluminum sheet, can provide similar effect to that of the present invention.

EXAMPLE 1

"Preparation of Laminated Steel Sheet"

As the base metal sheet, T4CA-TFS (100 to 120 mg/m$^2$ of metallic chromium layer, 14 to 18 mg/m$^2$ of chromium oxide hydrate layer, as metallic chromium), having 0.23 mm of thickness was used. The base metal sheet was treated by film-lamination method using thermal compression bonding, or by extrusion method, to form a resin layer specified by the present invention and a comparative resin layer. The thickness of the resin layer was 20 μm, 25 μm, and 30 μm, respectively. The plane orientation factor of the resin layer was determined by the following method.

"Determination of Plane Orientation Factor"

There were determined the refractive index Nx in the longitudinal direction of the film surface, the refractive index Ny in the width direction of the film surface, and the refractive index Nz in the thickness direction of the film using an Abbe's refractometer with a light source of sodium/D ray and an interim solution of methylene iodide, at a temperature of 25° C., thus calculated the plane orientation factor Ns by the following formula.

$$\text{Plane orientation factor } (Ns)=(Nx+Ny)/2-Nz$$

The prepared laminated steel sheets are shown in Table 1.

"Evaluation of Score Workability"

The prepared laminated steel sheets were subjected to score working using the respective score molds (upper molds) given in Table 2 and Table 3. All of the lower molds facing the score portion were in a flat shape. The residual thickness was 60 μm, and the working temperature was 80° C. and 25° C., respectively.

The cross sectional shape of the convex part for the types of (a) to (i) in Table 2 and Table 3 corresponds to each of FIGS. 3(*a*) to (*i*). The type (a) has the cross section of the convex part formed by a single curvature (circle), the type (b) has the cross section of the convex part in an inverted rectangular shape with a single curvature (circle) at the tip portion, while the oblique sides circumscribe the circle forming the tip portion, the type (c) has the cross section of the convex part formed by an elliptical curve, the type (d) has the cross section of the convex part in an inverted triangular shape, with an elliptical curve at the tip portion, while the oblique sides circumscribe the elliptical curve forming the tip portion, the type (e) is in a shape in which the mold (a) is divided at the top thereof in the vertical direction to widen in the right and the left directions, while forming a flat part between the peaks of widened sections, where the inclined surface is formed by a single curvature (arc of the original circle), and the flat part circumscribes the divided arc of the original circle, the type (f) is in a shape in which the mold (b) is divided at the top thereof in the vertical direction to widen in the right and the left directions, while forming a flat part between the peaks of widened sections, where the lower part of the inclined surface is formed by an arc of the original ellipse, and the flat surface circumscribes the arc of the divided original circle, the type (g) is in a shape in which the mold (c) is divided at the peak (lowest part) thereof in the vertical direction to widen in the right and the left directions, while forming a flat part between the peaks of widened sections, where the inclined surface is formed by an arc of the original ellipse, and the flat part circumscribes the arc of the divided original ellipse, the type (h) is in a shape in which the mold (d) is divided at the top thereof in the vertical direction to widen in the right and the left directions, while forming a flat part between the peaks of widened sections, where the lower part of the inclined surface is formed by an arc of the original ellipse, and the flat part circumscribes the arc of the divided original ellipse, and the type (i) has the cross section of the convex part in a wedge shape (inverted rectangular shape) with a flat part at top thereof.

At the worked part, a seal with a narrow window of 20 mm in diameter was attached to adjust the measurement length of 20 mm. Then, the narrow window portion was immersed in an electrolyte (solution of 5% KCl, normal temperature) to apply 6.2 V of voltage between the steel sheet and the electrolyte. The evaluation criterion was: grade "3" for the measured current of 0.001 mA or smaller, grade "2" for larger than 0.001 mA and not larger than 0.01 mA, grade "1" for larger than 0.01 mA and not larger than 0.1 mA, and grade "x" for larger than 0.1 mA. The evaluation was given to both the outer surface side to which the upper mold contacts, and the inner surface side. The evaluation grades "1" to "3" are acceptable, and the grade "x" is unacceptable (NG).

Table 4 and Table 5 show the evaluations of score workability.

(Description about Examples of the Invention and Comparative Examples)

Examples of the invention E-1 to E-68, which were the score-worked steel sheets prepared from the respective laminated steel sheets (Examples of the invention A-1 to A-18) specified by the present invention using the respective molds (Examples of the invention C-1 to C-17) specified by the present invention, showed good score workability.

Although Example of the invention A-13 had a small thickness of resin layer, as thin as 20 μm, it provided good score workability by applying Examples of the invention C-3, C-4-, C-9, C-11, C-16, and C-17 which were subjected to further preferable score working methods.

Comparative Example F-1 is an example of using the laminated steel sheet of Comparative Example B-1. Since the plane orientation factor of Comparative Example B-1 exceeded the range of the present invention, the score workability in Comparative Example F-1 became NG even with the application of score working method of the present invention.

Comparative Examples F-2 and F-3 are examples of using olefin-resin laminated steel sheets (Comparative Examples B-2 and B-3, respectively). They showed NG in the workability. Although the olefin resin has excellent elongation, it has low strength so that these sheets broke caused by the insufficient strength.

Comparative Example F-4 is an example of using a polycarbonate laminated steel sheet (Comparative Example B-4) It showed NG in the workability. Although the polycarbonate resin has high strength, it has low elongation so that the sheet broke at the elongation limit.

Comparative Example F-5 is an example of using the score mold in wedge shape (Comparative Example D-1). Although that type of mold is commonly applied to score working, it gave NG in the workability. The change rate of inclination came significantly outside the range of the present invention, which resulted in shear break.

Comparative Example F-6 is an example (Comparative Example D-2) of score mold having a single curvature, and having the change rate of inclination outside of the range of the present invention. The workability was evaluated as NG. The change rate of inclination came significantly outside the range of the present invention, which resulted in shear break.

Comparative Example F-7 is an example (Comparative Example D-3) of score mold having a single curvature, and having the score width outside the range of the present invention. The workability at 25° C. was evaluated as NG. Since the score width was large and the degree of working was large, break at the elongation limit occurred.

Comparative Example F-8 is a shape example (Comparative Example D-4) of score mold having a single curvature, and having a flat part at center of the score mold. The score width came outside the range of the present invention, and the workability was evaluated as NG. Since the score width was large and since the degree of working was large, the break at the elongation limit occurred.

Comparative Example F-9 is an example (Comparative Example D-5) of score mold having an inverted rectangular shape, and having a single curvature at the tip portion thereof. The change rate of inclination came outside the range of the present invention, and the workability was evaluated as NG. The shear break occurred.

Comparative Example F-10 is an example (Comparative Example D-6) of score mold having a flat part at center of the inverted triangular shape score. The score width came outside the range of the present invention, and-the workability at 25° C. was evaluated as NG. Since the score width was large and since the degree of working was large, break at the elongation limit occurred.

Comparative Example F-11 is an example (Comparative Example D-7) of score in an elliptical shape. The change rate of inclination came outside the range of the present invention, and the workability was evaluated as NG. The shear break occurred.

Comparative Example F-12. is a shape example (Comparative Example D-8) of score mold having a flat part at center of the elliptical shape score. The score width came outside the range of the present invention, and the workability at 25° C. was evaluated as NG. Since the score width was large and since the degree of working was large, break at the elongation limit occurred.

Comparative Example F-13 is an example (Comparative Example D-9) of score mold in an inverted triangular shape, having an elliptical shape at the tip portion thereof. The change rate of inclination came outside the range of the present invention, and the score width also came outside the range of the present invention. The workability was evaluated as NG.

Comparative Example F-14 is an example (Comparative Example D-10) of score mold in an inverted triangular shape, having a flat part at center of the elliptical shape at the tip portion. The score width came outside the range of the present inventions and the workability at 25° C. was evaluated as NG.

TABLE 1

| Laminated steel sheet | Kind of resin | Ethylene terephthalate mole % | Ethylene isophthalate mole % | Butylene terephthalate mole % | Plane orientation factor | Film thickness | Lamination method |
|---|---|---|---|---|---|---|---|
| Example A-1 | Polyester | 100 | 0 | 0 | 0.02 | 30 μm | Stretched film thermal compression bonding |
| Example A-2 | Polyester | 95 | 5 | 0 | 0.02 | 30 μm | Stretched film thermal compression bonding |
| Example A-3 | Polyester | 90 | 10 | 0 | 0.02 | 30 μm | Stretched film thermal compression bonding |
| Example A-4 | Polyester | 86 | 14 | 0 | 0.02 | 30 μm | Stretched film thermal compression bonding |
| Example A-5 | Polyester | 30 | 0 | 70 | 0.02 | 30 μm | Stretched film thermal compression bonding |
| Example A-6 | Polyester | 40 | 0 | 60 | 0.02 | 30 μm | Stretched film thermal compression bonding |
| Example A-7 | Polyester | 50 | 0 | 50 | 0.02 | 30 μm | Stretched film thermal compression bonding |
| Example A-8 | Polyester | 35 | 5 | 60 | 0.02 | 30 μm | Stretched film thermal compression bonding |
| Example A-9 | Polyester | 100 | 0 | 0 | 0.06 | 30 μm | Stretched film thermal compression bonding |
| Example A-10 | Polyester | 100 | 0 | 0 | 0.04 | 30 μm | Stretched film thermal compression bonding |
| Example A-11 | Polyester | 100 | 0 | 0 | 0 | 30 μm | Stretched film thermal compression bonding |
| Example A-12 | Polyester | 90 | 10 | 0 | 0.02 | 25 μm | Stretched film thermal compression bonding |
| Example A-13 | Polyester | 90 | 10 | 0 | 0.02 | 20 μm | Stretched film thermal compression bonding |
| Example A-14 | Polyester | 100 | 0 | 0 | 0 | 30 μm | Non-stretched film thermal compression bonding |
| Example A-15 | Polyester | 90 | 10 | 0 | 0 | 30 μm | Non-stretched film thermal compression bonding |
| Example A-16 | Polyester | 100 | 0 | 0 | 0 | 30 μm | Extrusion |
| Example A-17 | Polyester | 90 | 10 | 0 | 0 | 30 μm | Extrusion |
| Example A-18 | Polyester | 40 | 0 | 60 | 0 | 30 μm | Extrusion |
| Comparative Example B-1 | Polyester | 100 | 0 | 0 | 0.07 | 30 μm | Stretched film thermal compression bonding |
| Comparative Example B-2 | Polyethylene | | — | | | 30 μm | Stretched film thermal compression bonding |
| Comparative Example B-3 | Polypropylene | | — | | | 30 μm | Stretched film thermal compression bonding |

TABLE 1-continued

| Laminated steel sheet | Kind of resin | Ethylene terephthalate mole % | Ethylene isophthalate mole % | Butylene terephthalate mole % | Plane orientation factor | Film thickness | Lamination method |
|---|---|---|---|---|---|---|---|
| Comparative Example B-4 | Polycarbonate | | — | | | 30 μm | Stretched film thermal compression bonding |

TABLE 2

| Score mold | Type | | | | | Maximum change rate of inclination dtan θ/dx | Score width mm |
|---|---|---|---|---|---|---|---|
| Example C-1 | (a) Single curvature | | Curvature 0.29 mm | | | 0.062 | 0.54 |
| Example C-2 | (a) Single curvature | | Curvature 0.35 mm | | | 0.025 | 0.62 |
| Example C-3 | (a) Single curvature | | Curvature 0.46 mm | | | 0.010 | 0.73 |
| Example C-4 | (a) Single curvature | | Curvature 0.52 mm | | | 0.007 | 0.79 |
| Example C-5 | (e) Flat at center + Single curvature | Length of the flat part 0.020 mm | Curvature 0.35 mm | | | 0.062 | 0.56 |
| Example C-6 | (e) Flat at center + Single curvature | Length of the flat part 0.020 mm | Curvature 0.46 mm | | | 0.010 | 0.75 |
| Example C-7 | (b) Inverted triangle (Single curvature at tip portion) | Inclination of oblique side 1.52 | Curvature 0.10 mm | | | 0.057 | 0.36 |
| Example C-8 | (b) Inverted triangle (Single curvature at tip portion) | Inclination of oblique side 2.00 | Curvature 0.20 mm | | | 0.056 | 0.43 |
| Example C-9 | (b) Inverted triangle (Single curvature at tip portion) | Inclination of oblique side 0.67 | Curvature 0.32 mm | | | 0.006 | 0.71 |
| Example C-10 | (f) Flat at center + Inverted triangle (Single curvature at tip portion) | Length of the flat part 0.020 mm | Inclination of oblique side 2.00 | Curvature 0.20 mm | | 0.056 | 0.46 |
| Example C-11 | (f) Flat at center + Inverted triangle (Single curvature at tip portion) | Length of the flat part 0.020 mm | Inclination of oblique side 3.00 | Curvature 0.30 mm | | 0.006 | 0.73 |
| Example C-12 | (c) Ellipse | Major axis 0.40 mm | Minor axis 0.30 mm | | | 0.019 | 0.73 |
| Example C-13 | (c) Ellipse | Major axis 0.30 mm | Minor axis 0.25 mm | | | 0.075 | 0.58 |
| Example C-14 | (g) Flat at center + Ellipse | Length of the flat part 0.020 mm | Major axis 0.40 mm | Minor axis 0.30 mm | | 0.019 | 0.75 |
| Example C-15 | (g) Flat at center + Ellipse | Length of the flat part 0.020 mm | Major axis 0.30 mm | Minor axis 0.25 mm | | 0.075 | 0.60 |
| Example C-16 | (d) Inverted triangle (Ellipse at tip portion) | Inclination of oblique side 0.92 | Major axis 0.30 mm | Minor axis 0.25 mm | | 0.009 | 0.62 |
| Example C-17 | (h) Flat at center + Inverted triangle (Ellipse at tip portion) | Length of the flat part 0.020 mm | Inclination of oblique side 0.75 | Major axis 0.30 mm | Minor axis 0.25 mm | 0.010 | 0.71 |

TABLE 3

| Score mold | Type | | | | | Maximum change rate of inclination dtan θ/dx | Score width mm |
|---|---|---|---|---|---|---|---|
| Comparative Example D-1 | (i) Wedge shape | Length of flat part 0.020 mm | Inclination of oblique side 2.10 | | | 2.100 | 0.09 |
| Comparative Example D-2 | (a) Single curvature | | Curvature 0.25 mm | | | 0.178 | 0.48 |
| Comparative Example D-3 | (a) Single curvature | | Curvature 0.60 mm | | | 0.005 | 0.86 |
| Comparative Example D-4 | (e) Flat at center + Single curvature | Length of flat part 0.200 mm | Curvature 0.46 mm | | | 0.010 | 0.93 |
| Comparative Example D-5 | (b) Inverted triangle (Single curvature at tip portion) | Inclination of oblique side 2.00 | Curvature 0.10 mm | | | 0.109 | 0.30 |
| Comparative Example D-6 | (f) Flat at center + Inverted triangle (Single curvature at tip portion) | Length of flat part 0.150 mm | Inclination of oblique side 3.00 | Curvature 0.30 mm | | 0.006 | 0.86 |
| Comparative Example D-7 | (c) Ellipse | Major axis 0.30 mm | Minor axis 0.20 mm | | | 2.115 | 0.60 |
| Comparative Example D-8 | (g) Flat at center + Ellipse | Length of flat part 0.150 mm | Major axis 0.40 mm | Minor axis 0.30 mm | | 0.019 | 0.88 |

TABLE 3-continued

| Score mold | Type | | | | | Maximum change rate of inclination dtan θ/dx | Score width mm |
|---|---|---|---|---|---|---|---|
| Comparative Example D-9 | (d) Inverted triangle (Ellipse at tip portion) | Inclination of oblique side 0.75 | | Major axis 0.30 mm | Minor axis 0.25 mm | 0.495 | 1.02 |
| Comparative Example D-10 | (h) Flat at center + Inverted triangle (Ellipse at tip portion) | Length of flat part 0.200 mm | Inclination of oblique side 0.75 | Major axis 0.30 mm | Minor axis 0.25 mm | 0.010 | 0.89 |

TABLE 4

| Score worked laminated steel sheet | Laminated steel sheet | Score mold | Workability: Outer surface side 80° C. | Outer surface side 25° C. | Inner surface side 80° C. | Inner surface side 25° C. |
|---|---|---|---|---|---|---|
| Example E-1 | Example A-1 | Example C-2 | 3 | 3 | 3 | 3 |
| Example E-2 | | Example C-9 | 3 | 3 | 3 | 3 |
| Example E-3 | Example A-2 | Example C-2 | 3 | 3 | 3 | 3 |
| Example E-4 | | Example C-9 | 3 | 3 | 3 | 3 |
| Example E-5 | Example A-3 | Example C-2 | 3 | 3 | 3 | 3 |
| Example E-6 | | Example C-9 | 3 | 3 | 3 | 3 |
| Example E-7 | Example A-4 | Example C-2 | 3 | 3 | 3 | 3 |
| Example E-8 | | Example C-9 | 3 | 3 | 3 | 3 |
| Example E-9 | Example A-5 | Example C-2 | 3 | 3 | 3 | 3 |
| Example E-10 | | Example C-9 | 3 | 3 | 3 | 3 |
| Example E-11 | Example A-6 | Example C-2 | 3 | 3 | 3 | 3 |
| Example E-12 | | Example C-9 | 3 | 3 | 3 | 3 |
| Example E-13 | Example A-7 | Example C-2 | 3 | 3 | 3 | 3 |
| Example E-14 | | Example C-9 | 3 | 3 | 3 | 3 |
| Example E-15 | Example A-8 | Example C-2 | 3 | 3 | 3 | 3 |
| Example E-16 | | Example C-9 | 3 | 3 | 3 | 3 |
| Example E-17 | Example A-9 | Example C-2 | 3 | 2 | 3 | 3 |
| Example E-18 | | Example C-9 | 3 | 2 | 3 | 3 |
| Example E-19 | Example A-10 | Example C-2 | 3 | 3 | 3 | 3 |
| Example E-20 | | Example C-9 | 3 | 3 | 3 | 3 |
| Example E-21 | Example A-11 | Example C-2 | 3 | 3 | 3 | 3 |
| Example E-22 | | Example C-9 | 3 | 3 | 3 | 3 |
| Example E-23 | Example A-12 | Example C-1 | 2 | 3 | 3 | 3 |
| Example E-24 | | Example C-2 | 3 | 3 | 3 | 3 |
| Example E-25 | | Example C-9 | 3 | 3 | 3 | 3 |
| Example E-26 | Example A-13 | Example C-1 | 1 | 2 | 3 | 3 |
| Example E-27 | | Example C-2 | 2 | 3 | 3 | 3 |
| Example E-28 | | Example C-9 | 3 | 3 | 3 | 3 |
| Example E-29 | Example A-14 | Example C-2 | 3 | 3 | 3 | 3 |
| Example E-30 | | Example C-9 | 3 | 3 | 3 | 3 |
| Example E-31 | Example A-15 | Example C-2 | 3 | 3 | 3 | 3 |
| Example E-32 | | Example C-9 | 3 | 3 | 3 | 3 |
| Example E-33 | Example A-16 | Example C-2 | 3 | 3 | 3 | 3 |
| Example E-34 | | Example C-9 | 3 | 3 | 3 | 3 |
| Example E-35 | Example A-17 | Example C-2 | 3 | 3 | 3 | 3 |
| Example E-36 | | Example C-9 | 3 | 3 | 3 | 3 |
| Example E-37 | Example A-18 | Example C-2 | 3 | 3 | 3 | 3 |
| Example E-38 | | Example C-9 | 3 | 3 | 3 | 3 |

TABLE 5

| Score worked laminated steel sheet | Laminated steel sheet | Score mold | Workability: Outer surface side 80° C. | Outer surface side 25° C. | Inner surface side 80° C. | Inner surface side 25° C. |
|---|---|---|---|---|---|---|
| Example E-39 | Example A-1 | Example C-1 | 3 | 3 | 3 | 3 |
| Example E-40 | Example A-3 | | 3 | 3 | 3 | 3 |
| Example E-41 | Example A-3 | Example C-3 | 3 | 3 | 3 | 3 |
| Example E-42 | Example A-13 | | 3 | 3 | 3 | 3 |
| Example E-43 | Example A-3 | Example C-4 | 3 | 3 | 3 | 3 |
| Example E-44 | Example A-13 | | 3 | 3 | 3 | 3 |
| Example E-45 | Example A-3 | Example C-5 | 3 | 3 | 3 | 3 |

TABLE 5-continued

| Score worked laminated steel sheet | Laminated steel sheet | Score mold | Workability: Outer surface side 80° C. | Outer surface side 25° C. | Inner surface side 80° C. | Inner surface side 25° C. |
|---|---|---|---|---|---|---|
| Example E-46 | Example A-13 | | 1 | 2 | 3 | 3 |
| Example E-47 | Example A-3 | Example C-6 | 3 | 3 | 3 | 3 |
| Example E-48 | Example A-13 | | 3 | 3 | 3 | 3 |
| Example E-49 | Example A-3 | Example C-7 | 3 | 3 | 3 | 3 |
| Example E-50 | Example A-13 | | 1 | 2 | 3 | 3 |
| Example E-51 | Example A-3 | Example C-8 | 3 | 3 | 3 | 3 |
| Example E-52 | Example A-13 | | 1 | 2 | 3 | 3 |
| Example E-53 | Example A-3 | Example C-10 | 3 | 3 | 3 | 3 |
| Example E-54 | Example A-13 | | 1 | 2 | 3 | 3 |
| Example E-55 | Example A-3 | Example C-11 | 3 | 3 | 3 | 3 |
| Example E-56 | Example A-13 | | 3 | 3 | 3 | 3 |
| Example E-57 | Example A-3 | Example C-12 | 3 | 3 | 3 | 3 |
| Example E-58 | Example A-13 | | 2 | 3 | 3 | 3 |
| Example E-59 | Example A-3 | Example C-13 | 3 | 3 | 3 | 3 |
| Example E-60 | Example A-13 | | 1 | 2 | 3 | 3 |
| Example E-61 | Example A-3 | Example C-14 | 3 | 3 | 3 | 3 |
| Example E-62 | Example A-13 | | 2 | 3 | 3 | 3 |
| Example E-63 | Example A-3 | Example C-15 | 3 | 3 | 3 | 3 |
| Example E-64 | Example A-13 | | 1 | 2 | 3 | 3 |
| Example E-65 | Example A-3 | Example C-16 | 3 | 3 | 3 | 3 |
| Example E-66 | Example A-13 | | 3 | 3 | 3 | 3 |
| Example E-67 | Example A-3 | Example C-17 | 3 | 3 | 3 | 3 |
| Example E-68 | Example A-13 | | 3 | 3 | 3 | 3 |
| Comparative Example F-1 | Comparative Example B-1 | Example C-2 | X | X | X | X |
| Comparative Example F-2 | Comparative Example B-2 | Example C-2 | X | X | 3 | 3 |
| Comparative Example F-3 | Comparative Example B-3 | Example C-2 | X | X | 3 | 3 |
| Comparative Example F-4 | Comparative Example B-4 | Example C-2 | X | X | X | X |
| Comparative Example F-5 | Example A-3 | Comparative Example D-1 | X | X | 3 | 3 |
| Comparative Example F-6 | Example A-3 | Comparative Example D-2 | X | X | 3 | 3 |
| Comparative Example F-7 | Example A-3 | Comparative Example D-3 | 1 | X | 2 | 1 |
| Comparative Example F-8 | Example A-3 | Comparative Example D-4 | X | X | 1 | X |
| Comparative Example F-9 | Example A-3 | Comparative Example D-5 | X | X | X | X |
| Comparative Example F-10 | Example A-3 | Comparative Example D-6 | 1 | X | 2 | 1 |
| Comparative Example F-11 | Example A-3 | Comparative Example D-7 | X | X | 3 | 3 |
| Comparative Example F-12 | Example A-3 | Comparative Example D-8 | 1 | X | 2 | 1 |
| Comparative Example F-13 | Example A-3 | Comparative Example D-9 | X | X | X | X |
| Comparative Example F-14 | Example A-3 | Comparative Example D-10 | 1 | X | 2 | 1 |

The invention claimed is:

1. A mold apparatus comprising an upper mold and a lower mold facing the upper mold, thereby forming a score on one side of a can end fabricated by a resin-laminated metal sheet, wherein the upper mold has a convex part for forming the score, the convex part has a specified cross sectional shape at a part contacting the resin-laminated metal sheet, the cross sectional shape is composed of a curve having a change rate of inclination defined as $d\tan\theta/dx$ of 0.08 to 0.006 to the upper surface of the facing lower mold, or having the curve and a straight line, and the formed score has a maximum width of 0.80 mm to 0.36 mm.

2. The mold apparatus according to claim 1, wherein the upper surface of the lower mold facing the convex part of the mold for forming the score is flat and in parallel with the can end surface.

3. The mold apparatus according to claim 1, wherein the cross sectional shape is composed of a curve having a change rate of inclination of 0.050 or smaller to the upper surface of the facing lower mold, or having the curve and a straight line.

4. The mold apparatus according to claim 1, wherein the cross sectional shape is composed of a curve having a change rate of inclination of 0.01 or smaller to the upper surface of the facing lower mold, or having, the curve and a straight line, and the formed score has a maximum width of 0.75 mm or smaller.

5. The mold apparatus according to claim 1, wherein the cross sectional shape of the convex part has a single curvature.

6. The mold apparatus according to claim 5, wherein the cross sectional shape of the convex part has a radius of curvature in a range from 0.28 to 0.53 mm.

7. The mold apparatus according to claim 6, wherein the radius of curvature is in a range from 0.31 to 0.53 mm.

8. The mold apparatus according to claim 7, wherein the radius of curvature is in a range from 0.46 to 0.48 mm.

9. The mold apparatus according to claim 1, wherein the cross sectional shape of the convex part is in an inverted triangular shape, and the tip portion of the convex part has a single curvature.

10. The mold apparatus according to claim 1, wherein the cross sectional shape of the convex part is composed of an elliptical curve.

11. The mold apparatus according to claim 1, wherein the cross sectional shape of the convex part is in an inverted triangular shape, and the tip portion of the convex part is composed of an elliptical curve.

12. The mold apparatus according to claim 1, wherein the cross sectional shape of the convex part is composed of a single curvature at the inclined surface, and has a flat part at center thereof.

13. The mold apparatus according to claim 1, wherein the cross sectional shape of the convex part is composed of an elliptical shape at the inclined surface, and has a flat part at center thereof.

14. The mold apparatus according to claim 1, wherein the cross sectional shape of the convex part is in an inverted triangular shape, and is composed of a single curvature at lower part of the inclined surface, and has a flat part at center thereof.

15. The mold apparatus according to claim 1, wherein the sectional shape of the convex part is in an inverted triangular shape, is in an elliptical shape at lower part of the inclined surface, and has a flat part at center thereof.

16. The mold apparatus according to claim 1, wherein the sectional shape of the convex part is in an inverted triangular shape, and is flat at the tip portion thereof.

17. An easy-opening can end being manufactured by press-forming a resin-laminated metal sheet using the mold apparatus according to claim 1.

18. A method for manufacturing easy-opening can end comprising the step of forming a score by press-forming a laminated metal sheet using the mold apparatus according to claim 1.

19. The mold apparatus according to claim 1, wherein the resin-laminated metal sheet is a resin-laminated steel sheet.

20. A method for manufacturing easy-opening can end comprising the step of forming a score by press-forming a laminated steel sheet using the mold apparatus according to claim 1.

* * * * *